US008903256B2

(12) United States Patent
Shiori et al.

(10) Patent No.: US 8,903,256 B2
(45) Date of Patent: Dec. 2, 2014

(54) IMAGE FORMING APPARATUS AND IMAGE FORMING METHOD USED IN THE APPARATUS

(75) Inventors: Jun Shiori, Kanagawa (JP); Yukiko Iwasaki, Kanagawa (JP); Masaki Sukesako, Kanagawa (JP); Hiroyuki Sugiyama, Kanagawa (JP); Kazuaki Kamihara, Tokyo (JP); Hironobu Takeshita, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 309 days.

(21) Appl. No.: 13/035,115

(22) Filed: Feb. 25, 2011

(65) Prior Publication Data

US 2011/0211854 A1 Sep. 1, 2011

(30) Foreign Application Priority Data

Mar. 1, 2010 (JP) ..... 2010-044051

(51) Int. Cl.
*G03G 15/00* (2006.01)
*G03G 15/01* (2006.01)

(52) U.S. Cl.
CPC ..... *G03G 15/0178* (2013.01); *G03G 15/50* (2013.01); *G03G 2215/0103* (2013.01)
USPC ..... 399/53

(58) Field of Classification Search
CPC ..... G03G 15/00; G03G 15/0121; G03G 15/0136; G03G 15/08; G03G 15/06
USPC ..... 399/66, 148, 299
See application file for complete search history.

(56) References Cited

U.S. PATENT DOCUMENTS

| | | | | |
|---|---|---|---|---|
| 4,939,547 | A * | 7/1990 | Miyaji et al. | 399/228 |
| 5,303,011 | A * | 4/1994 | Noguchi et al. | 399/58 |
| 6,546,218 | B2 * | 4/2003 | Uchida | 399/167 |
| 7,545,149 | B2 * | 6/2009 | Picaud et al. | 324/522 |
| 7,667,861 | B2 * | 2/2010 | Umetani et al. | 358/1.12 |
| 2009/0279910 | A1 * | 11/2009 | Shiori | 399/50 |
| 2010/0040393 | A1 | 2/2010 | Kawahara et al. | |
| 2011/0026958 | A1 | 2/2011 | Shiori | |

FOREIGN PATENT DOCUMENTS

| | | |
|---|---|---|
| JP | 9-138540 | 5/1997 |
| JP | 2001-343809 | 12/2001 |
| JP | 2005-208363 | 8/2005 |
| JP | 2006-171233 | 6/2006 |
| JP | 2007-079289 | 3/2007 |
| JP | 2007-256932 | 4/2007 |

* cited by examiner

*Primary Examiner* — Benjamin Schmitt
*Assistant Examiner* — Matthew Miller
(74) *Attorney, Agent, or Firm* — Oblon, Spivak, McClelland, Maier & Neustadt, L.L.P.

(57) ABSTRACT

An image forming apparatus includes: a plurality of image forming units each with an image carrier on which an electrostatic latent image is formed, and each with a developing member for developing process on the electrostatic latent image, wherein the image forming apparatus superimposes toner images of the respective colors to form a composite color image; when images on a plurality of pages are formed, the developing members of the respective colors are started or stopped in response to presence or absence of latent images of the respective colors on a page that is targeted for image formation; and when the image forming unit starts to be driven, a developing member, corresponding to a color whose latent image is not to be formed on a first page of the plurality of pages, is not started.

21 Claims, 5 Drawing Sheets

| FIG. 5A |
|---|
| FIG. 5B |

IMAGE FORMING APPARATUS AND IMAGE FORMING METHOD USED IN THE APPARATUS

CROSS-REFERENCE TO RELATED APPLICATIONS

The present application claims priority to and incorporates by reference the entire contents of Japanese Patent Application No. 2010-044051 filed in Japan on Mar. 1, 2010.

BACKGROUND OF THE INVENTION

1. Field of the Invention

The present invention relates to an image forming apparatus such as a copying machine, a facsimile, and a printer employing electrophotography, or a Multi Function Peripheral (MFP) having the functions of the copying machine, facsimile, and printer, and image forming method applied in such apparatuses.

2. Description of the Related Art

Image forming apparatuses of recent years employing electrophotography include an increasing number of those that can form color images such as color copying machines and color printers. The image forming apparatuses particularly include an increasing number of tandem image forming apparatuses each with a plurality of developing units provided with corresponding photosensitive elements. In the tandem image forming apparatus, images are formed on the photosensitive elements with corresponding single-color toners. The single-color toner images thereby formed are transferred onto an intermediate transfer member while being sequentially superimposed on one another to form a composite color image. Then, the composite color image is transferred at one time on a recording sheet.

In order to form a two-color image or a three-color image in the aforementioned image forming apparatuses, an image forming unit corresponding to a color that is not to be used may be started. This unwanted driving operation results in wasteful power consumption while unnecessarily shortening the lifetime of each parts. According to the structure disclosed in Japanese Patent Application Laid-open No. H9-138540, it is determined if an output image includes image writing in a color except black, and if it is determined that there is no image writing in a color except black, a developing and stirring device for the color except black is stopped while an output image is produced. According to the structure disclosed in Japanese Patent Application Laid-open No. 2001-343809, an image carrier driving unit and a developing driving unit are controlled such that a developing unit of an image forming unit that is not intended to be used in image formation is stopped during the image formation. Further, the structure disclosed in Japanese Patent Application Laid-open No. 2006-171233 includes a contact section by which an intermediate transfer belt and a plurality of photosensitive elements are selectively caused to come into contact with each other, and separated from each other. In this structure, a photosensitive element corresponding to an intended color and the intermediate transfer belt are caused to come into contact with each other, while a photosensitive element corresponding to an unintended color and the intermediate transfer belt are separated from each other.

In Japanese Patent Application Laid-open No. 2006-171233, a photosensitive element corresponding to an unintended color is separated from the intermediate transfer belt. This should be done by an additional driving structure, resulting in cost increase and upsizing of the apparatus. Japanese Patent Application Laid-open No. 2006-171233, as well as Japanese Patent Application Laid-open No. H9-138540 and Japanese Patent Application Laid-open No. 2001-343809, does not place consideration on how to deal with a situation where a color to be used for image formation changes from one page to another page when images are to be formed sequentially on a plurality of pages. According to Japanese Patent Application Laid-open No. H9-138540, a developing and stirring device for black as an initial color is always started; therefore, toner of black or of an initial color is always stirred even if black or the initial color is not used for image writing.

A problem to be solved by the invention is to prevent deterioration due to unnecessary stirring of toner or a developer of a color that is not to be consumed in image formation over a plurality of pages.

SUMMARY OF THE INVENTION

It is an object of the present invention to at least partially solve the problems in the conventional technology.

According to an aspect of the present invention, there is provided an image forming apparatus comprising: a plurality of image forming units each with an image carrier on which an electrostatic latent image is formed, and each with a developing member responsible for developing process on the electrostatic latent image formed on the image carrier, wherein the image carriers and the developing members of the plurality of image forming units are provided for different colors; the image forming apparatus superimposes toner images of the respective colors formed on the image carriers as a result of the developing process to form a composite color image; when images on a plurality of pages are formed, the developing members of the respective colors are started or stopped in response to presence or absence of latent images of the respective colors on a page that is targeted for image formation; and when the image forming unit starts to be driven, a developing member, corresponding to a color whose latent image is not to be formed on a first page of the plurality of pages, is not started.

According to another aspect of the present invention, there is provided an image forming apparatus comprising: a plurality of image forming means each with an image carrier on which an electrostatic latent image is formed, and each with a developing member responsible for developing process on the electrostatic latent image formed on the image carrier, wherein the image carriers and the developing members of the plurality of image forming means are provided for different colors; the image forming apparatus superimposes toner images of the respective colors formed on the image carriers as a result of the developing process to form a composite color image; when images on a plurality of pages are formed, the developing members of the respective colors are started or stopped in response to presence or absence of latent images of the respective colors on a page that is targeted for image formation; and when the image forming means starts to be driven, a developing member, corresponding to a color whose latent image is not to be formed on a first page of the plurality of pages, is not started.

According to still another aspect of the present invention, there is provided an image forming method for an image forming apparatus, wherein the image forming apparatus including: a plurality of image forming units each with an image carrier on which an electrostatic latent image is formed, and each with a developing member responsible for developing process on the electrostatic latent image formed on the image carrier, wherein the image carriers and the developing members of the plurality of image forming units are provided for different colors; the image forming apparatus superimposes toner images of the respective colors formed on the image carriers as a result of the developing process to form a composite color image, the image forming method comprising: a first image forming that, when images on a plurality of pages are formed, the developing members of the respective colors are started or stopped in response to presence or absence of latent images of the respective colors on a page that is targeted for image formation; and a second image forming that, when the image forming unit starts to be driven, a developing member, corresponding to a color whose latent image is not to be formed on a first page of the plurality of pages, is not started.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A printer employing electrophotography (hereinafter simply called printer) is described below as an image forming apparatus of an image forming system to which the present invention is applied.

Figure 1:
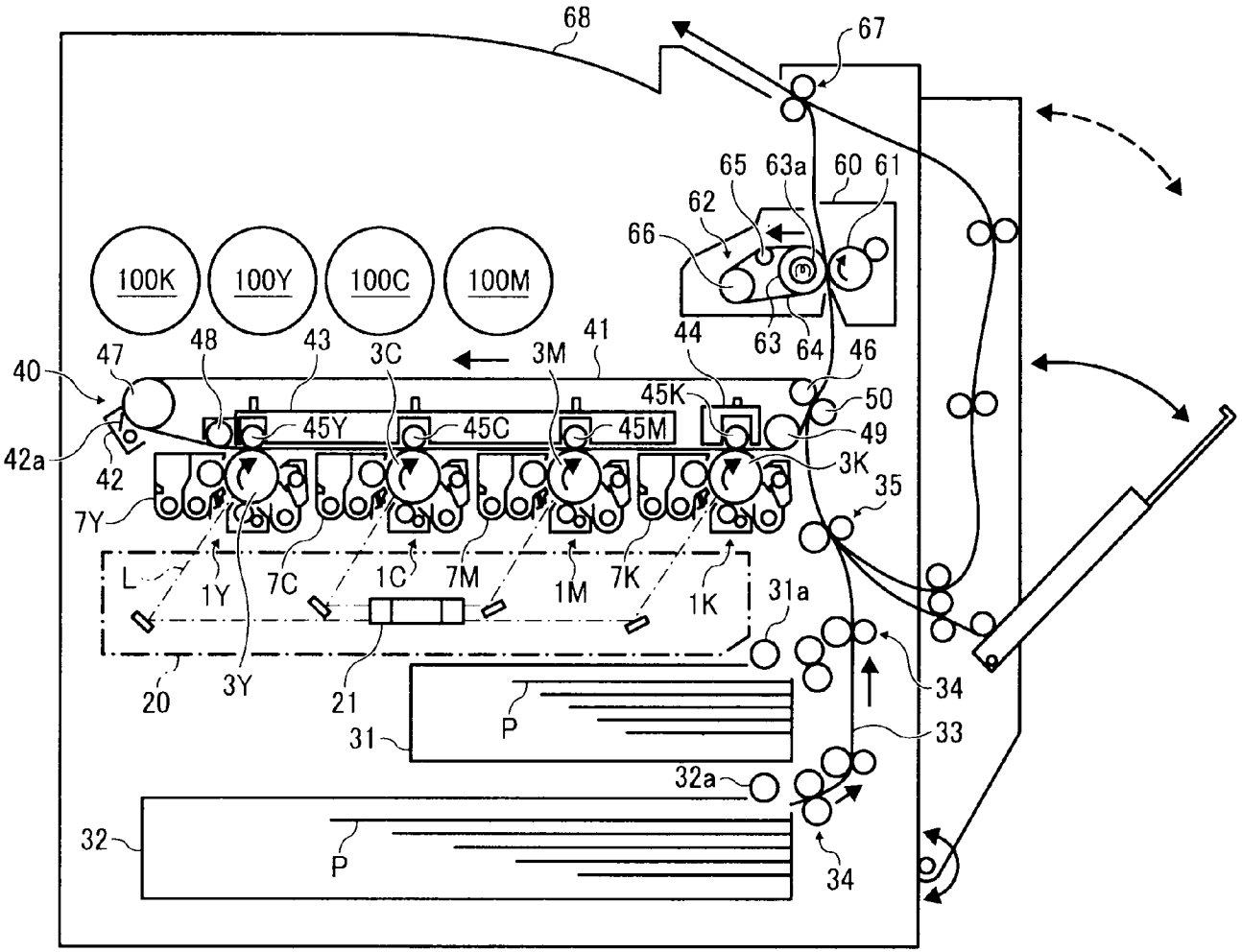
FIG. 1 is a schematic view showing the general structure of a printer as an example of an image forming apparatus according to the present invention.
Figure 2:
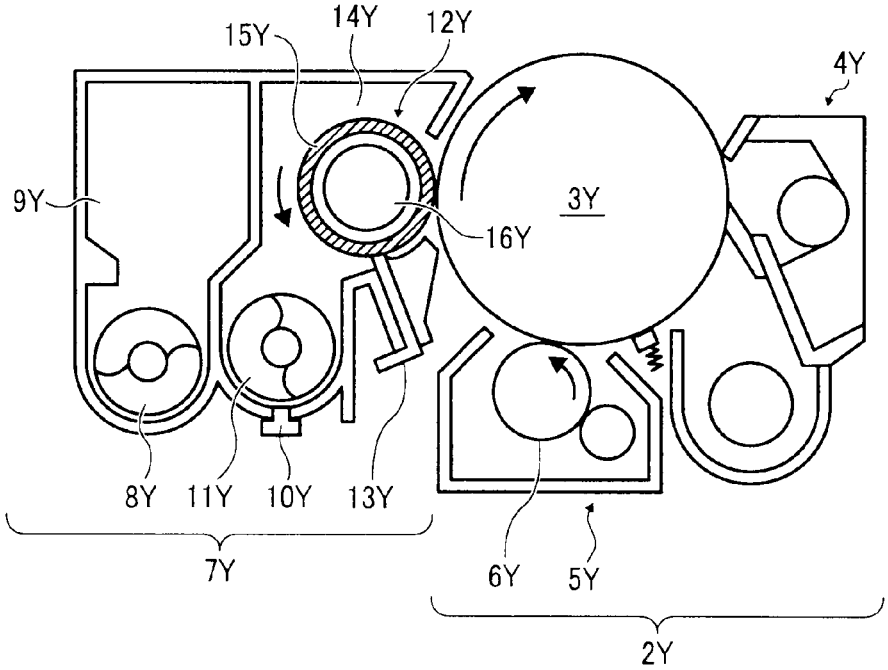
FIG. 2 is a schematic view showing the structure of an yellow image forming unit.
Figure 3:
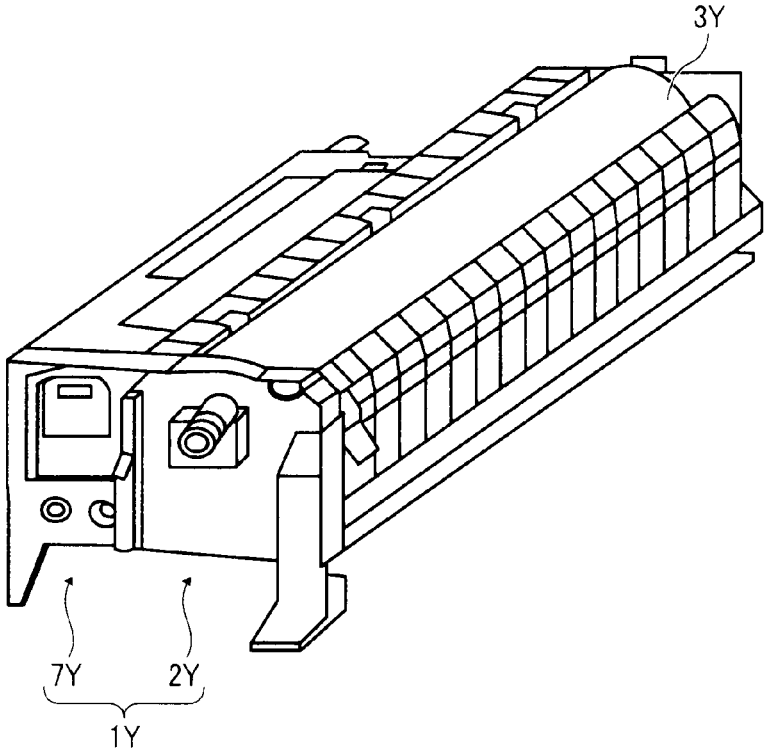
FIG. 3 is a schematic perspective view of an image forming unit.
Figure 4:
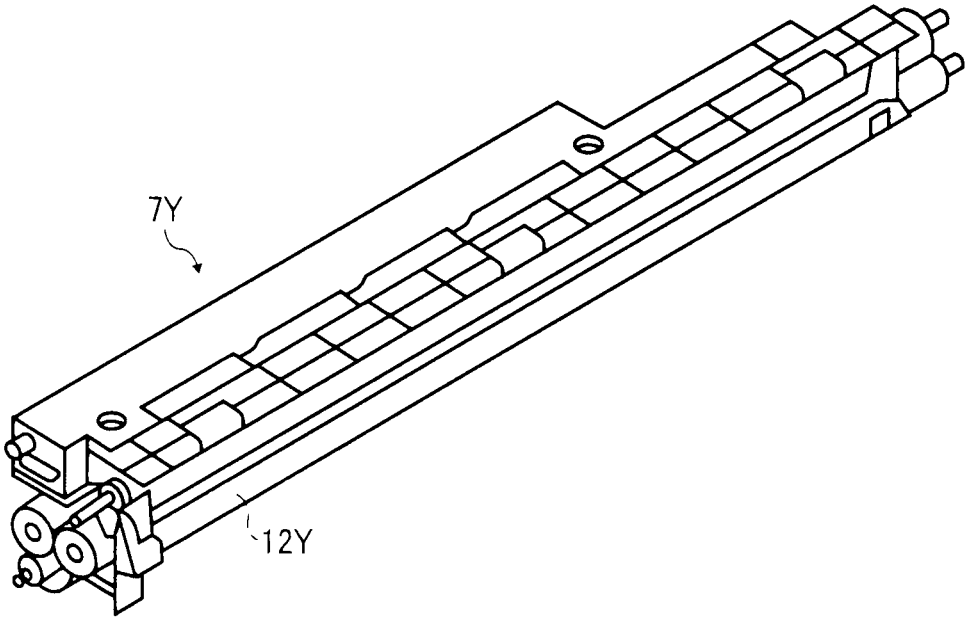
FIG. 4 is a schematic perspective view of a developing unit.

First, the basic structure of the printer is described. The printer shown in FIG. 1 includes four image forming units 1Y, 1C, 1M, and 1K for forming toner images of yellow, magenta, cyan, and black (hereinafter identified as Y, C, M, and K). These image forming units are of the same structure, except that they use Y toner, C toner, M toner, and K toner of different colors that are materials used for image formation, respectively. With reference, for example, to the image forming unit 1Y for forming a Y toner image, the image forming unit 1Y includes a photosensitive unit 2Y and a developing unit 7Y as shown in FIG. 2. The photosensitive unit 2Y and the developing unit 7Y can integrally be attached and detached as the image forming unit 1Y to and from the printer body as shown in FIG. 3. As shown in FIG. 4, if detached from the printer body, the developing unit 7Y may be attached to and detached from a photosensitive unit not shown.

Returning to FIG. 2, the photosensitive unit 2Y includes: a photosensitive element 3Y in the form of a drum to function as a latent image carrier; a drum cleaning device 4Y; a neutralization device not shown; a charging device 5Y; and the like. The charging device 5Y makes a surface of the photosensitive element 3Y uniformly charged while the photosensitive element 3Y is caused to rotate in a clockwise direction in the drawing by a driving member not shown. The charging device 5Y shown in FIG. 2 is of such a system where a power source not shown applies a charging bias onto the photosensitive element 3Y so as to be uniformly charged by a charging roller 6Y that rotates counterclockwise in the drawing and that is made come nearer to the photosensitive element 3Y. The charging roller 6Y may be replaced by a charging brush. The photosensitive element 3Y may uniformly be charged by a charging system employed, for example, with a scorotron charger. The surface of the photosensitive element 3Y, uniformly charged by the charging device 5Y, holds thereon a Y electrostatic latent image that is formed by exposure and scanning with a laser beam emitted from an optical writing unit described later.

The developing unit 7Y to function as a developing member includes a first agent housing part 9Y in which a first carriage screw 8Y is placed. The developing unit 7Y also includes a second agent housing part 14Y in which a toner concentration sensor 10Y constructed of a magnetic permeability sensor (hereinafter called toner concentration sensor), a second carriage screw 11Y, a developing roll 12Y, a doctor blade 13Y, and the like are placed. These two agent housing parts contain a Y developer (not shown) with magnetic carriers and Y toner of negative charging property. The first carriage screw 8Y is caused to rotate by a driving member not shown, and carries the Y developer in the first agent housing part 9Y from the front side toward the rear side in a direction perpendicular to the drawing sheet. Then, the Y developer is caused to go into the second agent housing part 14Y through a communicating port (not shown) provided in a partition wall between the first agent housing part 9Y and the second agent housing part 14Y.

The second carriage screw 11Y in the second agent housing part 14Y is caused to rotate to carry the Y developer from the deeper side toward the nearer side in the drawing. The toner concentration of the Y developer being carried is determined by the toner concentration sensor 10Y fixed on the bottom part of the second agent housing part 14Y. The developing roll 12Y is provided above the second carriage screw 11Y and in parallel with the second carriage screw 11Y. The developing roll 12Y includes a developing sleeve 15Y constructed of a nonmagnetic pipe that is caused to rotate counterclockwise in the drawing, and a magnet roller 16Y surrounded by the developing sleeve 15Y. Part of the Y developer carried by the second carriage screw 11Y is drawn up onto a surface of the developing sleeve 15Y by magnetic force generated by the magnet roller 16Y. Next, the Y developer is controlled in thickness by the doctor blade 13Y spaced apart from the developing sleeve 15Y as a developing member by a predetermined distance, and is thereafter carried to a developing region opposite to the photosensitive element 3Y. Then, the Y toner is caused to stick to a Y electrostatic latent image on the photosensitive element 3Y, thereby forming a Y toner image on the photosensitive element 3Y. The Y developer, whose Y toner was consumed in the development, is returned back to the second carriage screw 11Y by the rotation of the developing sleeve 15Y. After being carried to the nearer end in the drawing, the Y developer is returned back into the first agent housing part 9Y through a communicating port not shown.

The magnetic permeability of the Y developer determined by the toner concentration sensor 10Y is given as a voltage signal to a control unit not shown. The magnetic permeability of the Y developer shows a correlation with the Y toner concentration of the Y developer. This means that the toner concentration sensor 10Y outputs a voltage of a value responsive to the Y toner concentration. The control unit mentioned above includes a RAM that stores data of Y $V_{tref}$ that is a target value of an output voltage from the toner concentration sensor 10Y, and data of C $V_{tref}$, M $V_{tref}$, and K $V_{tref}$ that are target values of output voltages from toner concentration sensors in the other developing units. Referring to the Y developing unit 7Y, the Y developing unit 7Y compares the value of an output voltage from the toner concentration sensor 10Y and Y $V_{tref}$, and causes a Y toner supplying device described later to operate for a time responsive to a result of the comparison. As a result, in the first agent housing part 9Y, Y toner of an appropriate amount is added to the Y developer whose Y toner concentration was reduced as a result of consumption of the Y toner in the development. Thus, the Y toner concentration in the second agent housing part 14Y is maintained to fall within a predetermined range. The developers in the image forming units (1C, 1M, and 1K) for the other colors are given the corresponding toners in the same way.

The Y toner image formed on the photosensitive element 3Y is transferred in an intermediate transfer process onto an intermediate transfer belt described later. The drum cleaning device 4Y removes the toner left on a surface of the photosensitive element 3Y in a stage after the intermediate transfer process. The surface of the photosensitive element 3Y thereby cleaned is neutralized by the neutralization device not shown. As a result, the surface of the photosensitive element 3Y is initialized, and is made prepared for subsequent image formation. In the image forming units 1C, 1M, and 1K for the other colors shown in FIG. 1, a C toner image, an M toner image, and a K toner image are also formed on photosensitive elements 3C, 3M, and 3K, respectively, and are transferred onto the intermediate transfer belt in the intermediate transfer process.

Returning to FIG. 1, an optical writing unit 20 is arranged below the image forming units 1Y, 1C, 1M, and 1K in the drawing. The optical writing unit 20 to function as a latent image forming unit projects a laser beam L to each of the photosensitive elements 3Y, 3C, 3M, and 3K of the image forming units 1Y, 1C, 1M, and 1K on the basis of image information, whereby Y, C, M, and K electrostatic latent images are formed on the photosensitive elements 3Y, 3C, 3M, and 3K, respectively. The optical writing unit 20 is configured so as to apply the laser beam L emitted from a light source through a plurality of optical lenses and mirrors to the photosensitive elements 3Y, 3C, 3M, and 3K while deflecting the laser beam L with a polygon mirror 21 caused to rotate by a motor. The optical writing unit 20 may also be configured such that it performs optical scanning with an LED array.

A first paper cassette 31 and a second paper cassette 32 are arranged below the optical writing unit 20 in such a manner that the first paper cassette 31 and the second paper cassette 32 are overlaid on each other in the vertical direction. These paper cassettes each store a bundle of a plurality of overlaid recording sheets P to function as recording media. The top recording sheets P in the first paper cassette 31 and the second paper cassette 32 are in contact with a first paper feeding roller 31*a* and a second paper feeding roller 32*a*, respectively. When the first paper feeding roller 31*a* is caused to rotate in the anticlockwise direction in the drawing by a driving member not shown, the top recording sheet P in the first paper cassette 31 is discharged toward a feed path 33 extending in the vertical direction on the right side of the first paper cassette 31 in the drawing. When the second paper feeding roller 32*a* is caused to rotate in the anticlockwise direction in the drawing by a driving member not shown, the top recording sheet P in the second paper cassette 32 is discharged toward the feed path 33. A plurality of pairs of carriage rollers 34 are provided in the feed path 33. The recording sheet P fed into the feed path 33 is carried from the lower side toward the upper side in the drawing through the feed path 33 while being held between the rollers of the pairs of carriage rollers 34.

A pair of registration rollers 35 are provided at the end of the feed path 33. The rotation of the rollers of the pair of registration rollers 35 is stopped immediately after a recording sheet P fed from the pairs of carriage rollers 34 is placed between the rollers of the pair of registration rollers 35. Then, the recording sheet P is fed at an appropriate time toward a secondary transfer nip described later.

A transfer unit 40 is arranged above the image forming units 1Y, 1C, 1M, and 1K in the drawing. While keeping an intermediate transfer belt 41 under tension, the transfer unit 40 causes the intermediate transfer belt 41 to circulate endlessly in the anticlockwise direction in the drawing. The transfer unit 40 to function as a transfer member includes a belt cleaning unit 42, a first bracket 43 and a second bracket 44, and the like in addition to the intermediate transfer belt 41. The transfer unit 40 also includes four primary transfer rollers 45Y, 45C, 45M, and 45K; a secondary transfer backup roller 46; a driving roller 47; an auxiliary roller 48; a tension roller 49; and the like. While being kept under tension by these eight rollers, the intermediate transfer belt 41 is caused to circulate endlessly in the anticlockwise direction in the drawing by the rotation of the driving roller 47. The four primary transfer rollers 45Y, 45C, 45M, and 45K, and the photosensitive elements 3Y, 3C, 3M, and 3K hold therebetween the intermediate transfer belt 41 caused to circulate endlessly so as to form respective primary transfer nips. Then, the primary transfer rollers 45Y, 45C, 45M, and 45K apply transferring biases of a polarity (positive, for example) opposite to that of toner to the back side of the intermediate transfer belt 41 (inner surface of the loop). While the intermediate transfer belt 41 sequentially passes through the respective primary transfer nips for Y, C, M, and K as a result of its endless circulation, the Y, C, M, and K toner images on the photosensitive elements 3Y, 3C, 3M, and 3K, respectively, are primarily transferred onto the front side of the intermediate transfer belt 41 such that they are superimposed on one another. As a result, a four-color superimposed toner image (hereinafter called four-color toner image) is formed on the intermediate transfer belt 41.

The secondary transfer backup roller 46 and a secondary transfer roller 50, arranged outside the loop of the intermediate transfer belt 41, hold therebetween the intermediate transfer belt 41 so as to form the secondary transfer nip. The pair of registration rollers 35 feed the recording sheet P held between the rollers of the pair of registration rollers 35 toward the secondary transfer nip in synchronization with the forming of the four-color toner image on the intermediate transfer belt 41. The four-color toner image on the intermediate transfer belt 41 is secondarily transferred at one time onto the recording sheet P in the secondary transfer nip under the influence of a secondary transfer electric field generated between the secondary transfer roller 50 and the secondary transfer backup roller 46 to which a secondary transferring bias is applied under the influence of a nip pressure. The secondarily transferred image becomes a full-color toner image as a result of adding the white of the original recording sheet P as a white color.

The belt cleaning unit 42 removes residual toner left on the intermediate transfer belt 41 without having been transferred onto the recording sheet P after the intermediate transfer belt 41 having been passed through the secondary transfer nip. The belt cleaning unit 42 includes a cleaning blade 42*a* that comes into contact with the front side of the intermediate transfer belt 41 to remove the residual transfer toner by scraping the toner off the belt.

A fixing unit 60 is arranged above the secondary transfer nip in the drawing. The fixing unit 60 includes a pressing and heating roller 61 with a heat source therein such as a halogen lamp, and a fixing belt unit 62. The fixing belt unit 62 includes a fixing belt 64 to function as a fixing member, a heating roller 63 with a heat source 63*a* therein such as a halogen lamp, a tension roller 65, a driving roller 66, and the like. The endless fixing belt 64 is caused to circulate endlessly in the anticlockwise direction in the drawing while being kept under tension by the heating roller 63, the tension roller 65, and the driving roller 66. The fixing belt 64 is heated from its back side by the heating roller 63 while circulating endlessly. The fixing belt 64 thereby heated is wound on the heating roller 63 at a position at which the pressing and heating roller 61 caused to rotate in the clockwise direction in the drawing is in contact with the front side of the fixing belt 64. This contact between the pressing and heating roller 61 and the fixing belt 64 forms a fixing nip.

A temperature sensor not shown is arranged outside the loop of the fixing belt 64 in such a manner that the temperature sensor is opposite to the front side of the fixing belt 64 with a predetermined space therebetween. The temperature sensor monitors the surface temperature of the fixing belt 64 immediately before the fixing belt 64 enters the fixing nip. A result of the measurement is given to a fixing power supply circuit not shown. The fixing power supply circuit performs on-off control of power supply to the heat source 63*a* in the heating roller 63 and to a heat source in the pressing and heating roller 61 on the basis of the result of measurement made by the temperature sensor. Thus, the surface temperature of the fixing belt 64 is kept at about 140° C.

The recording sheet P having passed through the secondary transfer nip is separated from the intermediate transfer belt 41, and is fed into the fixing unit 60 thereafter. Then, the recording sheet P held in the fixing nip of the fixing unit 60 is heated and pressed by the fixing belt 64 and the pressing and heating roller 61 while being carried from the lower side toward the upper side in the drawing. As a result, a full-color toner image is fixed on the recording sheet P.

The recording sheet P after the fixing process is next placed between the rollers of a pair of discharging rollers 67, and is then discharged to the outside of the apparatus. A stacking part 68 is provided on the upper surface of the housing of the printer body. Recording sheets P discharged to the outside of the apparatus by the pair of discharging rollers 67 are sequentially stacked in the stacking part 68.

Four toner cartridges 100Y, 100C, 100M, and 100K are arranged above the transfer unit 40 that stores Y toner, C toner, M toner, and K toner, respectively. The toners of the corresponding colors in the toner cartridges 100Y, 100C, 100M, and 100K are appropriately supplied to the developing units 7Y, 7C, 7M, and 7K of the image forming units 1Y, 1C, 1M, and 1K, respectively. The toner cartridges 100Y, 100C, 100M, and 100K can be attached to and detached from the printer body independently of the image forming units 1Y, 1C, 1M, and 1K.

Generally, the image forming operation with the aforementioned structure roughly includes two modes: monochrome mode and full-color mode. In the monochrome mode, in response to a request for printing in the monochrome mode, the apparatus performs image formation without making the intermediate transfer belt come into contact with the Y, C, and M photosensitive elements; and without starting the Y, C, and M photosensitive elements, and the Y, C and M developing units. In the full-color mode, in response to a request for printing in the full-color mode, the apparatus performs image formation while making the intermediate transfer belt come into contact with the Y, C, and M photosensitive elements; and while starting photosensitive elements and developing units of all colors. What should be noted here is the case of printing of an image in a small number of colors although such printing is not done in the monochrome mode, and the case of single-color copying or two-color copying using a color except black. As described above, the operation mode of the image forming apparatus in related arts generally includes only two types: monochrome mode and full-color mode. Accordingly, a conventional apparatus is put into operation to perform printing in the full-color mode in response to a request for such printing. In such a case of printing in the full-color mode, there may be a color that is not intended to be used in image formation. Accordingly, an actual situation is that a load is imposed on toner and a developer of this color due to their unnecessary stirring, resulting in a probability of deterioration. This generates degradation of image quality during subsequent image formation such as print dropout, reduction of image density, and generation of a stain on a primary surface. This problem cannot be solved without consumption and supply of toner at a large amount, or without exchange of an image forming unit before the end of its original life duration.

Figures 5, 5A:
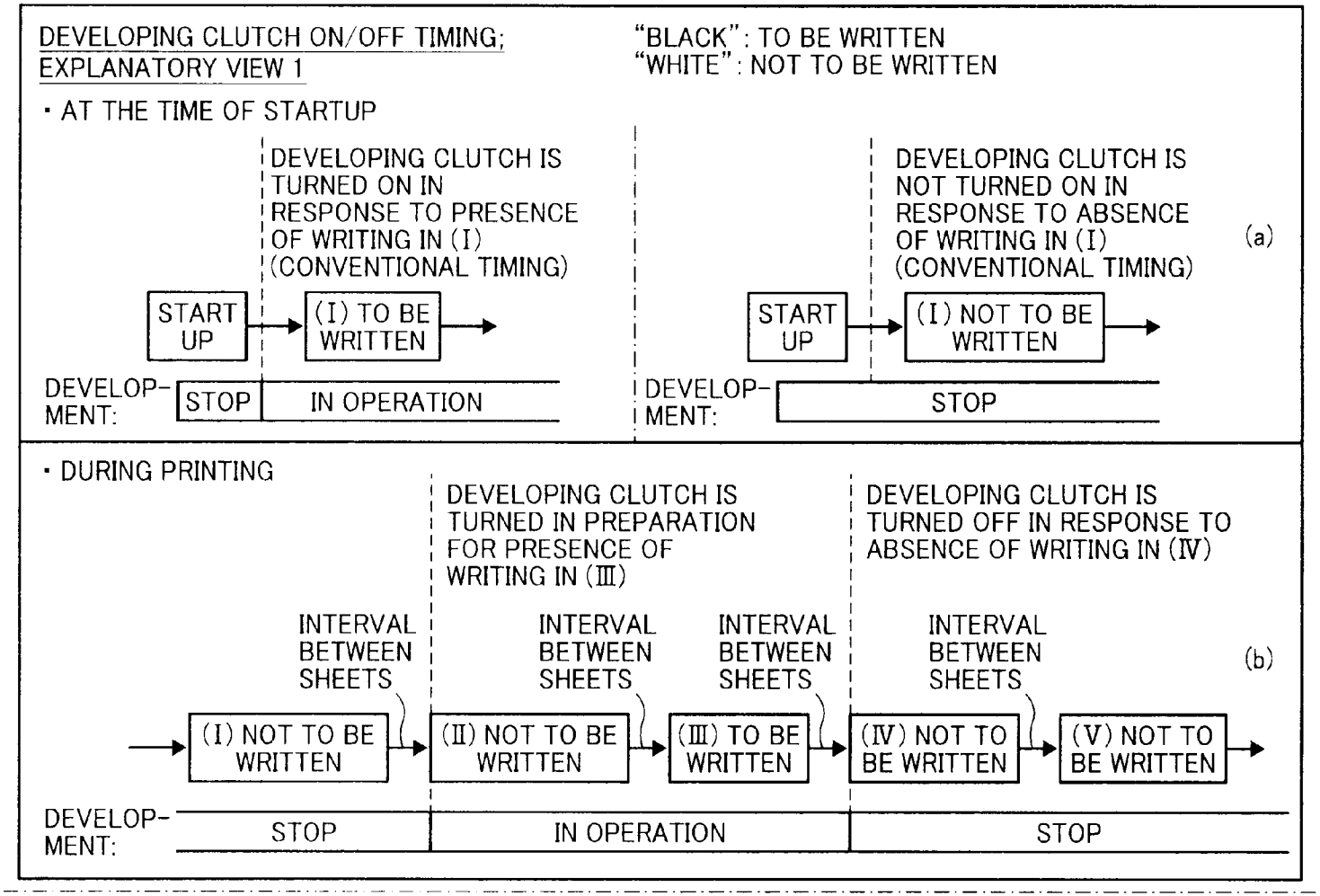
FIG. 5 is a view for explaining timing of start and timing of stop of a developing unit.
Figure 5B:
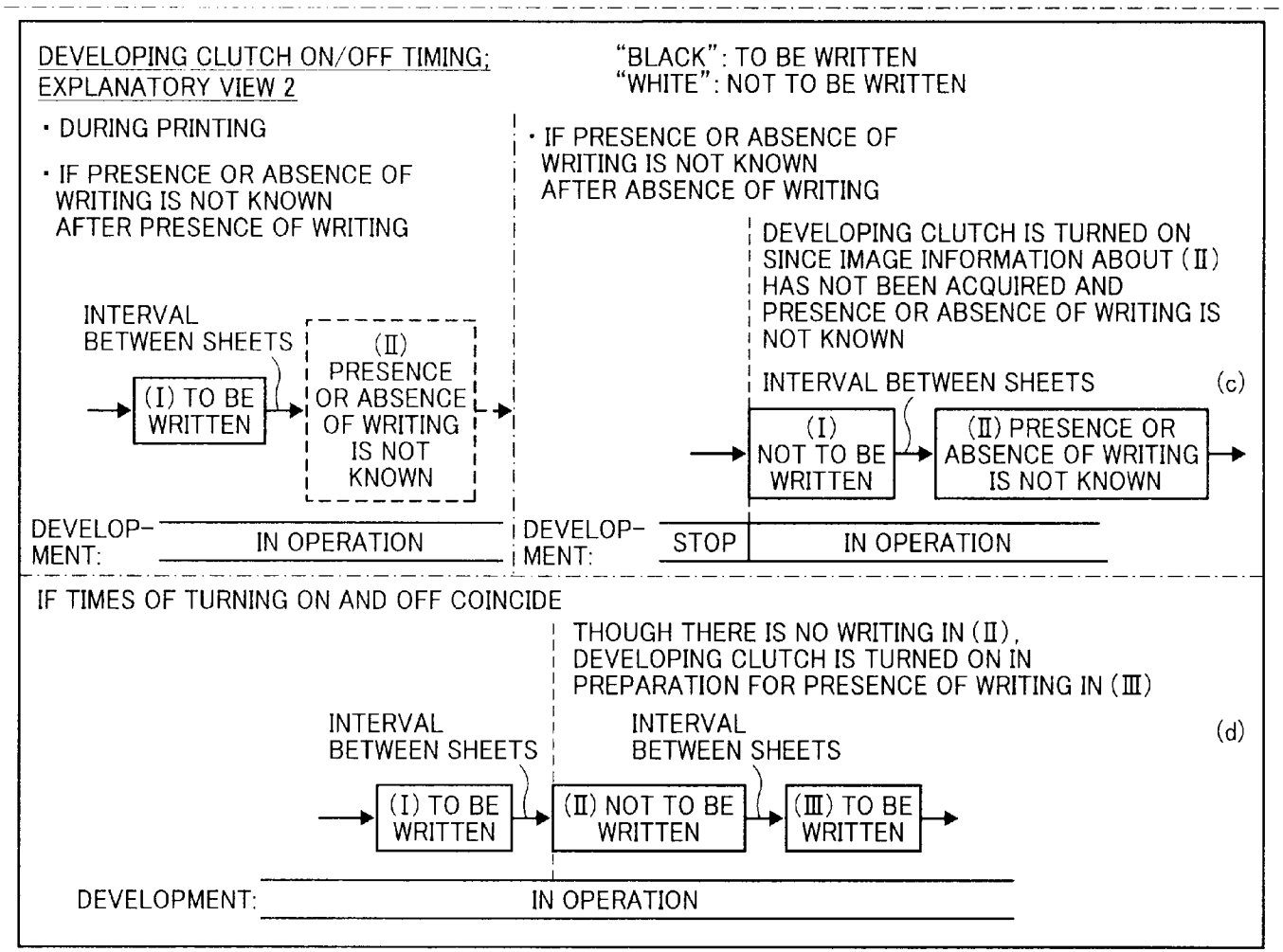

In the invention, in response to the aforementioned problem, a developing unit of a color that is not intended to be used is not started, while a photosensitive element should still be started as it is in contact with an intermediate transfer belt. Thus, toner and a developer do not deteriorate as they are not stirred unnecessarily. Specifically, the apparatus recognizes the presence or absence of writing in each color of K, M, C and Y for each page during printing, and starts a developing unit/image forming unit of only a color targeted for writing. Regarding a color that is not targeted for image writing on a first page after printing is started, a developing unit is not started at the startup as shown (a) in FIG. 5, so that unnecessary stirring is reduced as much as possible.

Timing of start and timing of stop of a developing unit of each color are described next. With attention focused on a certain color, if it is determined that the color is not targeted for writing on a next page while a developing unit corresponding to this color is in operation in successive printing. In this case, as shown (b) in FIG. 5, the developing unit is stopped after the rear end of an image on a page immediately before is transferred from a corresponding photosensitive element. If the developing unit is started through a clutch by a photosensitive element driving motor, stopping the developing unit, namely disengaging the clutch, varies a burden imposed on the photosensitive element driving motor. This changes the rotating speed of the photosensitive element, thereby generating density irregularity in a sub-scanning direction, change in length of an image, and color shift. If the developing unit is configured to be started by a developing motor of a corresponding color, the same abnormalities may be generated due to variations in pressure of an agent in a developing nip. In contrast, if the developing unit is stopped at a time after transfer to a previous page is finished, an image will not be influenced by the aforementioned change of the speed. This change of rotating speed of the photosensitive element may naturally be generated also when the clutch is engaged, or when the developing motor is started. A time required for recovery from the speed change is generally determined by the speed of rotation. Accordingly, in order to start the stopped developing unit during successive printing, the developing unit may be started at least a time required for the recovery earlier than start of writing. This prevents an influence to be exerted on an image. In the example shown as (b) in FIG. 5, a time required for the recovery is allowed for regarding writing on a third page. In this example, the developing unit is started at an initial time of writing on a second page for which the aforementioned color is not targeted.

If a post-processing operation such as stapling and punching, or entry process of image data into an apparatus take long time, it may not be clear until immediately before start of writing if the aforementioned color is targeted for writing on a next page. In this case, if the developing unit is started at a time when the presence or absence of writing in the color is determined, recovery from the change of rotating speed of the photosensitive element cannot be completed before start of writing, thereby generating an abnormal image. In response, as shown, for example, (c) in FIG. 5, the developing unit is started in advance at a time corresponding to start of writing on a previous page, so that the aforementioned generation of an abnormal image is prevented.

As described above, if the developing unit is started and stopped, namely if a clutch is engaged and disengaged in response to the presence or absence of writing for each page, the mechanical lifetime of the clutch might be shortened compared to a conventional case. In response, disengagement of the clutch is timed to coincide with start of writing on a next page that is assumed to occur. Further, engagement of the clutch is timed to coincide with start of writing on a page immediately before a page targeted for writing. If the times of disengagement and engagement of the clutch coincide with each other, priority is given to the engagement of the clutch as shown (d) in FIG. 5. This reduces the number of times of engagement and disengagement of the clutch, while an effect achieved by reducing unnecessary stirring of the developing unit may decrease slightly. This lessens an influence on the lifetime of the clutch, and prevents generation of an abnormal image.

In the present invention, in order to form images on a plurality of pages, the developing members of the respective colors are started or stopped in response to the presence or absence of latent images of the respective colors on a page targeted for image formation. Regarding a color whose latent image is not formed on a first page of the plurality of pages, a developing member corresponding to the color is not started when an image forming starts. This can precisely prevent deterioration of toner or a developer due to its unnecessary stirring, prevents cost increase, prevents generation of an abnormal image before it happens, and extends the lives of supplies and units.

Regarding a color whose latent image is not to be formed on a next page while a developing member corresponding to the color is in operation, the developing member is stopped after the rear end of an image on a previous page is transferred. Regarding a color whose latent image is to be formed on a next page while a developing member corresponding to the color is stopped, the developing member is started a predetermined time earlier than start of formation of the latent image on the next page. If a control unit for the developing member cannot acquire information about the presence or absence of latent image formation on the next page after elapse of a predetermined time, the developing member is started. Stop of each of the developing members is timed to coincide with start of formation of a latent image on a next page that is assumed to occur. Start of the developing member is timed to coincide with start of formation of a latent image on a previous page. If the times of stop and start of the developing member coincide with each other, priority is given to the start of the developing member. Thus, deterioration of toner or a developer due to its unnecessary stirring is appropriately prevented.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a plurality of image forming units, each of the image forming units including an image carrier on which an electrostatic latent image is formed, and each image forming unit includes a developing unit responsible for developing process on the electrostatic latent image formed on the image carrier, wherein with respect to a first image forming unit of the plurality of image forming units, a driving control of a developing unit for the first image forming unit is performed such that:

(a) in the case where a second image forming unit of the plurality of image forming units performs image formation of a page while the first image forming unit does not perform image formation of the page, and then the first image forming unit performs image formation of a subsequent page, a developing unit of the first image forming unit starts to be driven at a time when the second image forming unit starts writing of a latent image of the page on an image carrier;

(b) in the case where the first image forming unit performs image formation of a page, and then the first image forming unit does not perform image formation of a subsequent page, the developing unit being driven of the first image forming unit is stopped at a time when the second image forming unit starts writing of a latent image of the subsequent page on the image carrier; and (c) in the case where the drive start time and the drive stop time of the developing unit of the first image forming unit coincide with each at other, priority is given to the drive start time to start driving of the developing unit of the first image forming unit.

2. The image forming apparatus according to claim 1, wherein while a developing unit, corresponding to a color whose latent image is not to be formed on a next page, is in operation, the developing unit is stopped after a rear end of an image on a previous page has been transferred.

3. The image forming apparatus according to claim 1, wherein while a developing unit, corresponding to a color whose latent image is to be formed on a next page, is stopped, the developing unit is started a predetermined time earlier than start of formation of a latent image on the next page.

4. The image forming apparatus according to claim 3, further comprises a control unit that controls the developing unit, wherein if the control unit cannot acquire information about the presence or absence of the latent image formation on the next page after elapse of the predetermined time, the developing unit is started.

5. The image forming apparatus according to claim 3, wherein the developing unit is started through a clutch by a driving source and a change in a rotating speed of the image carrier occurs due to connection to the clutch, and wherein the predetermined time is a time required for recovery from the change in the rotating speed.

6. The image forming apparatus according to claim 3, wherein the developing unit is started through a clutch by a driving source, and a change in a rotating speed of the image carrier occurs when the driving source starts driving, and wherein the predetermined time is a time required for recovery from the change in the rotating speed.

7. A method of forming an image with a plurality of image forming units, each of the image forming units including an image carrier on which an electrostatic latent image is formed, and each image forming unit includes a developing unit responsible for developing process on the electrostatic latent image formed on the image carrier, the method comprising:

performing a driving control of a developing unit with respect to a first image forming unit of the plurality of image forming units such that:

(a) in the case where a second image forming unit of the plurality of image forming units performs image formation of a page while the first image forming unit does not perform image formation of the page, and then the first image forming unit performs image formation of a subsequent page, starting driving of a developing unit of the first image forming unit at a time when the second image forming unit starts writing of a latent image of the page on an image carrier;

(b) in the case where the first image forming unit performs image formation of a page, and then the first image forming unit does not perform image formation of a subsequent page, stopping the developing unit being driven of the first image forming unit at a time when the second image forming unit starts writing of a latent image of the subsequent page on the image carrier; and (c) in the case where the drive start time and the drive stop time of the developing unit of the first image forming unit coincide with each at other, giving priority to the drive start time to start driving of the developing unit of the first image forming unit.

8. The method according to claim 7, further comprising:

while a developing unit, corresponding to a color whose latent image is not to be formed on a next page, is in operation, stopping the developing unit after a rear end of an image on a previous page has been transferred.

9. The method according to claim 7, further comprising:

while a developing unit, corresponding to a color whose latent image is to be formed on a next page, is stopped, starting the developing unit a predetermined time earlier than start of formation of a latent image on the next page.

10. The method according to claim 9, further comprising:

controlling the developing unit with a control unit; and starting the developing unit if the control unit cannot acquire information about the presence or absence of the latent image formation on the next page after elapse of the predetermined time.

11. The method according to claim 9, wherein the developing unit is started through a clutch by a driving source and a change in a rotating speed of the image carrier occurs due to connection to the clutch, and wherein the predetermined time is a time required for recovery from the change in the rotating speed.

12. The method according to claim 9, wherein the developing unit is started through a clutch by a driving source, and a change in a rotating speed of the image carrier occurs when the driving source starts driving, and wherein the predetermined time is a time required for recovery from the change in the rotating speed.

13. An image forming apparatus comprising:

a plurality of image forming means for forming an image, each of the image forming means includes a carrying means for carrying an image on which an electrostatic latent image is formed, and each image forming means includes a developing means for developing process on the electrostatic latent image formed on the carrying means, wherein with respect to a first image forming means of the plurality of image forming means, a driving control means of a means for developing for the first image forming means is performed such that:

(a) in the case where a second image forming means of the plurality of image forming means performs image formation of a page while the first image forming means does not perform image formation of the page, and then the first image forming means performs image formation of a subsequent page, a developing means of the first image forming means starts to be driven at a time when the second image forming means starts writing of a latent image of the page on a carrying means;

(b) in the case where the first image forming means performs image formation of a page, and then the first image forming means does not perform image formation of a subsequent page, the developing means being driven of the first image forming means is stopped at a time when the second image forming means starts writing of a latent image of the subsequent page on the means for carrying an image; and (c) in the case where the drive start time and the drive stop time of the developing means of the first image forming means coincide with each at other, priority is given to the drive start time to start driving of the developing means of the first image forming means.

14. The image forming apparatus according to claim 13, wherein while a developing means, corresponding to a color whose latent image is not to be formed on a next page, is in operation, the developing means is stopped after a rear end of an image on a previous page has been transferred.

15. The image forming apparatus according to claim 13, wherein while a developing means, corresponding to a color whose latent image is to be formed on a next page, is stopped, the developing means is started a predetermined time earlier than start of formation of a latent image on the next page.

16. The image forming apparatus according to claim 15, further comprises a control means that controls the developing means, wherein if the control means cannot acquire information about the presence or absence of the latent image formation on the next page after elapse of the predetermined time, the developing means is started.

17. The image forming apparatus according to claim 15, wherein the developing means is started through a clutch by a driving means and a change in a rotating speed of the means for carrying an image occurs due to connection to the clutch, and wherein the predetermined time is a time required for recovery from the change in the rotating speed.

18. The image forming apparatus according to claim 15, wherein the developing means is started through a clutch by a driving means, and a change in a rotating speed of the image carrier means occurs when the driving means starts driving, and wherein the predetermined time is a time required for recovery from the change in the rotating speed.

19. The image forming apparatus according to claim 1, wherein the developing unit is connected to a driving source through a clutch.

20. The method according to claim 7, wherein the developing unit is connected to a driving source through a clutch.

21. The image forming apparatus according to claim 13, wherein the means for developing is connected to a driving source through a clutch.

* * * * *